US006357683B1

(12) United States Patent
Patzelt et al.

(10) Patent No.: US 6,357,683 B1
(45) Date of Patent: Mar. 19, 2002

(54) ROLLER GRINDING MILL

(75) Inventors: Norbert Patzelt, Beckum; Johann Knecht, Munich, both of (DE)

(73) Assignee: Krupp Polysius AG, Beckum (DE)

( * ) Notice: Subject to any disclaimer, the term of this patent is extended or adjusted under 35 U.S.C. 154(b) by 0 days.

(21) Appl. No.: 09/601,389

(22) PCT Filed: Feb. 8, 1999

(86) PCT No.: PCT/EP99/00816

§ 371 Date: Jul. 29, 2000

§ 102(e) Date: Jul. 29, 2000

(87) PCT Pub. No.: WO99/39830

PCT Pub. Date: Aug. 12, 1999

(30) Foreign Application Priority Data

Feb. 9, 1998 (DE) ..... 198 05 137

(51) Int. Cl.[7] ..... B02C 1/08

(52) U.S. Cl. ..... 241/235; 241/230; 241/232

(58) Field of Search ..... 241/227, 230–231, 241/232–233, 234, 235; 72/237, 238, 245; 100/168, 169, 170

(56) References Cited

U.S. PATENT DOCUMENTS

| | | | | | |
|---|---|---|---|---|---|
| 3,166,257 | A | * | 1/1965 | Pick et al. | 241/234 |
| 4,817,407 | A | * | 4/1989 | Alich | 72/245 |
| 5,253,816 | A | * | 10/1993 | Kastingschafer et al. | 241/227 |
| 5,522,557 | A | * | 6/1996 | Tiggesbaumker et al. | 241/231 |
| 5,553,796 | A | * | 9/1996 | Bettenworth | 241/230 |

FOREIGN PATENT DOCUMENTS

EP 0280897 B1 5/1991

OTHER PUBLICATIONS

"Cement–Data–Book", Duda, vol. 1, 3rd Ed, 1985.

* cited by examiner

*Primary Examiner*—Ed Tolan
(74) *Attorney, Agent, or Firm*—Muramatsu & Associates

(57) ABSTRACT

The invention relates to a roll mill with two rolls which are rotatably mounted in a machine frame and have an outer wear protection casing. In order to facilitate a particularly simple and rapid replacement of the wear protection casings on the rolls, both rolls are mounted only at one end in the machine frame.

8 Claims, 2 Drawing Sheets

ROLLER GRINDING MILL

The application is a 35 USC 371 of PCT/EP99/00816 filed Feb. 8, 1999.

FIELD OF THE INVENTION

The invention relates to a roll mill, particularly in the form of a material bed roll mill which is capable for simple and quick replacement of wear protection casings.

BACKGROUND OF THE INVENTION

Roll mills and material bed roll mills of the aforementioned type are known in various forms. Thus, for example, the general construction and the principle of comminution of material bed roll mills is explained in Duda, CEMENT-DATA-BOOK, Volume 1, 3rd Edition, 1985, for instance pages 255 to 257. A further example of a known roll mill is disclosed in EP-B-0 280 897.

These roll mills are preferably used in instances where relatively brittle mill feed material is to be comminuted in a particularly energy-saving mode of operation, particularly for the comminution of cement raw materials, cement clinker, ore materials, coal and the like. The rolls which are pressed against one another with a relatively high pressing force are each mounted by way of a roll shaft in the vicinity of both ends of the rolls so as to be rotatable by way of bearings in bearing jewels which are held—so as to be partially movable—in a machine frame. Both rolls are driven either by way of a common drive motor or by way of individual drive means.

In the type of comminution described above, the roll surfaces are subjected to a high degree of wear. For this reason the rolls of these roll mills, particularly of the material bed roll mills, are equipped with outer wear protection casings which after they are worn can be replaced by new or reclaimed wear protection casings. This replacement of the wear protection casings on the rolls necessitates high expenditure of labour and time, quite apart from the fact that during this replacement work the roll mill is out of operation and thus not available for comminution of material.

SUMMARY OF THE INVENTION

The object of the invention, therefore, is to create a roll mill, particularly a material bed roll mill in which the construction by comparison with the known mill designs permits particularly simple and rapid replacement of the wear protection casings on the rolls.

This object is achieved according to the invention by the characterizing feature involved for easy replacement of the wear protection casings.

Since in the known roll mill constructions—as explained above—each roll is mounted by way of its roll shaft so as to be rotatable in bearings or bearing jewels which are disposed in the machine frame at both ends of the rolls, it is generally necessary to remove the mountings and possibly a part of the machine frame first of all before the actual work for replacement of the wear protection casing of the corresponding roll can be undertaken.

On the other hand, in the roll mill according to the invention the two rolls are only mounted at one end in the machine frame, i.e. the mountings for the roll shaft of each roll are only disposed in the vicinity of one end of the roll, whilst the opposite end of the roll is freely accessible. Thus this means that, when work becomes necessary for replacement of a wear protection casing, the corresponding roll is or both rolls are freely accessible from the opposite end thereof to the mountings; thus—by comparison with the known mill constructions—the installation work for mountings or parts of the machine frame can be omitted. Merely in this way the expenditure of labour and time for replacement of the wear protection casings on the rolls of a roll mill according to the invention can be significantly reduced—again by comparison with the known constructions.

For reasons of strength, with the relatively high grinding pressures in a roll mill constructed as a material bed roll mill the wear protection casing of each roll is frequently constructed as a closed ring. In this case the construction according to the invention is especially advantageous, since the entire ring-shaped wear protection casing can be replaced in one piece relatively quickly, by comparison with wear protection casings which are made up of segments. It should also be added that ring-shaped wear protection casings can be manufactured particularly inexpensively, thus providing an economical mode of operation of the roll mill.

During the comminuting operation in a material bed roll mill it is known that pressing forces or contact pressures of more than approximately 50 MPa and up to approximately 400 MPa and possibly more occur, and these pressing forces are a function of the nature of the material for comminution and also of the desired comminuting work or the end product. Thus for example the pressing forces during the comminution of cement materials, particularly cement clinker, lie in the upper pressure ranges of the pressing forces mentioned above, whilst for the comminution for example of material from the mining industry (e.g. ore material) pressures in the middle or lower range of the aforementioned pressing forces may be sufficient. Especially for comminuting work with pressing forces which lie in these middle and lower pressure ranges the roll mill according to the invention in the form of a material bed roll mill is particularly advantageous.

BRIEF DESCRIPTION OF THE DRAWINGS

The invention will be explained in greater detail below with reference to the drawings. These drawings have been kept very diagrammatic and in them.

5

DETAILED DESCRIPTION OF THE INVENTION

Figure 1:
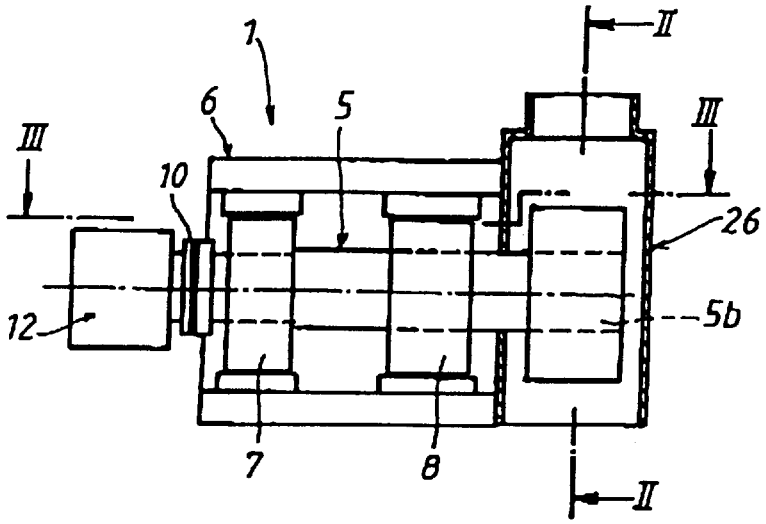
FIG. 1 shows a longitudinal sectional view through the roll mill according to the invention, approximately along the section line I—I in FIG. 3.

The drawings show the roll mill according to the invention in its preferred embodiment as a material bed roll mill 1.

This material bed roll mill 1 contains two rolls 2, 3. Each roll 2, 3 has only one roll shaft 4 or 5, respectively, which projects axially on one side and is rotatably mounted in at least two (as in the present example) bearing jewels 7, 8, respectively, which are disposed in a machine frame 6 and are axially spaced from one another. In the illustrated embodiment, the end 4*a* or 5*a* of each respective roll shaft 4 or 5, opposite the respective appertaining roll 2 or 3 is, in each case, connected by way of a corresponding clutch 9, 10 to a respective separate drive arrangement (motor and gear) 11 or 12. In this way, both rolls 2, 3 can be driven so that they rotate in opposite directions—corresponding to the arrows 13 and 14 in FIG. 2.

In so far as the mounting of the roll shafts 4, 5 is concerned, it is advantageous if each first bearing jewel 8 adjacent to the appertaining roll 2 or 3 respectively is retained and guided on the machine frame 6 as a bearing jewel which is freely displaceable transversely with respect to the axis of rotation 2*a* or 3*a* respectively of the roll. On the other hand, each second bearing jewel 7 which is remote from the roll 2 or 3 respectively is disposed so as to be stationary but pivotable about a pivot axis 7*a* extending transversely with respect to the axis of rotation 2*a* or 3*a* respectively of the roll.

Furthermore, movements of the roll shafts 4, 5 can be compensated for if an object which is particularly hard or cannot be comminuted passes through the rolls 2, 3 and as a result these rolls are temporarily pushed apart. However, as an alternative to this, each second bearing jewel 7 can also be disposed so as to be stationary and fixed against rotation, in which case the pivotability of the roll shafts 4, 5 approximately about the pivot axis 7*a* in the region of these second bearing jewels 7 can then be achieved by suitable bearings (e.g. self-aligning roller bearings). Movability in the region of the second bearing jewel 7 could also be achieved for example by a resilient cushion.

Each of the first bearing jewels 8 adjacent to the rolls 2, 3 is—as is usual in material bed roll mills—coordinated with pressing arrangements 15 by means of which these first bearing jewels 8 and thus the rolls 2, 3 are pressed against one another resiliently—as indicated by arrows—with the necessary strong pressing forces, and these pressing forces can be adjustable. At least one pressing cylinder supplied with a pressure medium, particularly a hydraulic pressing cylinder or a hydropneumatic pressing cylinder, can be co-ordinated with each first bearing jewel 8 in a manner which is known per se as a pressing arrangement 15. Furthermore, it is also basically possible for only one of these first bearing jewels 8 to be supplied with a corresponding pressure with the aid of at least one such pressing cylinder. The opposing first bearing jewel 8 of the other roll shaft in each case can then be supported on an adjustable stop.

The first bearing jewels 8 of the two rolls 2, 3 which are resiliently pressed against one another are disposed parallel adjacent to one another in the machine frame 6 in the normal operational state of the roll mill 1. In this case a distance piece 16, which is preferably adjustable, is provided in the region between these two first bearing jewels 8 for setting a minimum gap spacing (so-called "zero gap") between the rolls 2, 3. Optionally the said minimum gap spacing between the two rolls 2, 3 can also be maintained by mounting a fixed stop on one of these first bearing jewels 8 against which the other first bearing jewel 8 (for the adjacent roll shaft) can rest.

In order to be able to set the desired or necessary gap spacing or working gap(s) parallel between the two rolls 2, 3, the first and second bearing jewels 8, 7 of both roll shafts 4 or 5 respectively can advantageously be adjusted in their reciprocal spacing perpendicular or transversely with respect to the axis of rotation 2*a* or 3*a* respectively of the roll.

Figure 3:
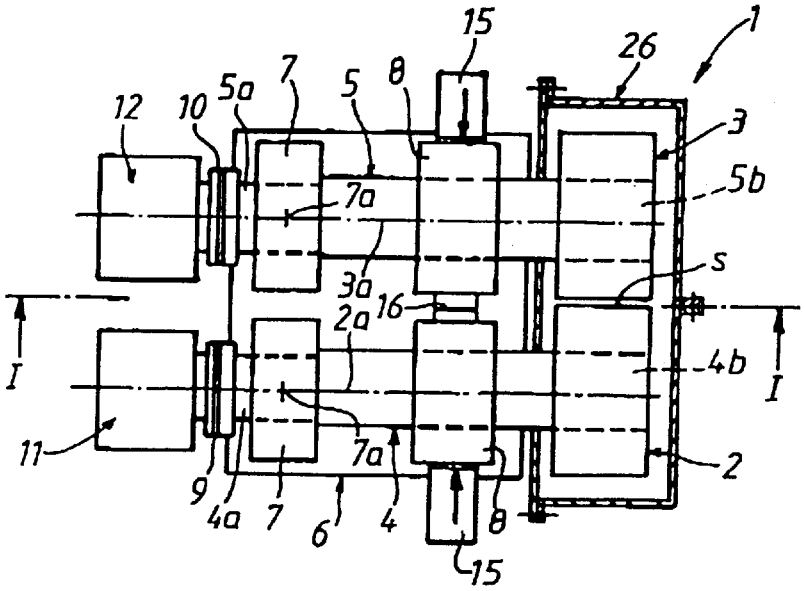
FIG. 3 shows a partially cut-away plan view approximately along the line III—III in FIG. 1.
Figure 4:
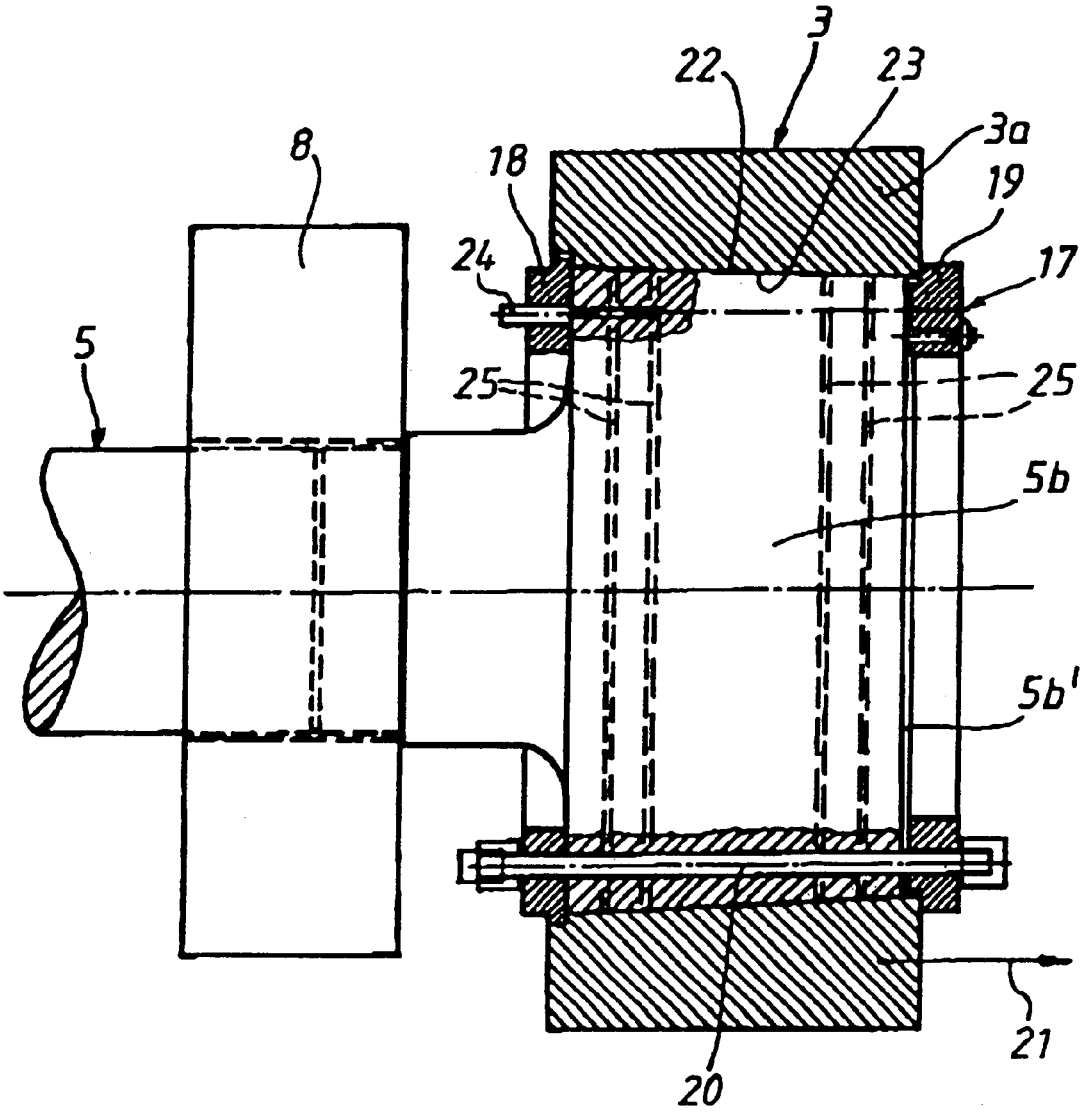
FIG. 4 shows an enlarged sectional view of a detail corresponding to the line IV—IV in FIG. 2.

From the preceding explanations it is clear that in this material bed roll mill 1 according to the invention the two rolls 2, 3 are mounted only at one end in the machine frame 6, as is shown in FIGS. 1 and 3 but can also be observed from FIG. 4 which has yet to be explained. As has already been explained above, in this way the possibility is created of being able to replace wear parts fixed on the roll shafts 4, 5 without prior removal of bearings or mountings and possibly parts of the machine frame 6.

At its free end 4*b* or 5*b* respectively which projects with respect to the first bearing jewels 8, each roll shaft 4, 5 is constructed in the form of a basic roll body, as illustrated in particular in the enlarged sectional view of a detail in FIG. 4 with reference to the roll shaft 5 with the roll 3. Since the roll 2 with its roll shaft 4 is constructed in the same way as the roll 3 with its shaft 5, only the one roll 3 with its shaft 5 needs to be described in greater detail with reference to FIG. 4.

Figure 2:
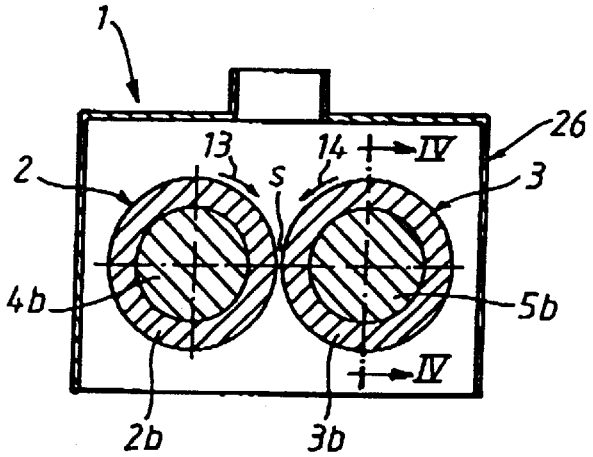
FIG. 2 shows a cross-sectional view along the line II—II in FIG. 1.

As shown in FIG. 4, but also in FIG. 2, a wear protection casing 2*b* or 3*b* respectively in the form of a closed ring is replaceably fixed on the free end 4*b* or 5*b* respectively of each roll shaft 4, 5 by means of a clamping connection 17. This clamping connection 17 can contain conventional lock rings 18, 19 which are disposed on both ends of the roll 3 and are clamped against one another by tightening screws 20 so that the wear protection casing 3*b* (and also 2*b* in the same way) is firmly but replaceably disposed on the appertaining end 5*b* (or 4*b* respectively) of the roll which serves as the basic roll body.

In this case this (or each) wear protection casing 3*b* is fixed so that it can be removed towards the free end (4*b* or 5*b* respectively) of the shaft, as indicated by the arrow 21. For this purpose the free end 4*b* or 5*b* respectively of the shaft bearing the wear protection casing 2*b* or 3*b* respectively is constructed on its outer circumference—as can be seen in FIG. 4—as a seating surface 22 which tapers conically towards the free end face 5*b*' of this shaft end 5*b*, whilst the wear protection casing 3*b* (or 2*b* respectively) has on its inner circumference a conical counter-seating surface 23 which is constructed corresponding thereto. Thus in the clamped state each wear protection casing 2*b* or 3*b* respectively is to a certain extent retained and secured with a close fit on the appertaining shaft end 4*b* or 5*b* respectively in the manner of a tire.

With this type of fixing of each wear protection casing 2*b* or 3*b* respectively on the appertaining shaft end 4*b* or 5*b* respectively it is considered particularly advantageous with a view to rapid removal of these wear protection casings if an oil pressing arrangement is coordinated with each roll 2, 3, wherein this oil pressing arrangement—according to FIG. 4—contains at least one oil connection pipe 24 as well as a plurality of oil distributor channels 25 which are produced within the free shaft end 4*b* or 5*b* respectively and supply the seating surfaces 22, 23 with high-pressure oil delivered to the oil connection pipe 24.

The outer end of the oil connection pipe 24 can be provided with a corresponding valve so that, if required, this oil connection pipe 24 can be connected to a highpressure oil supply system in order to deliver high-pressure oil into the region of the seating surfaces 22, 23 between the wear protection casings 2*b*, 3*b* and the free shaft ends 4*b* or 5*b* respectively. In this way rapid and simple removal of a worn wear protection casing can be ensured.

The wear protection casing could equally well be designed so that it consists of a plurality of rings. The advantage in this case is to be seen in particular in the lower weight of the individual wear parts, so that simple replacement is facilitated.

In order during the comminution at least of relatively dry brittle mill feed material to prevent inadmissible dust emission, this roll mill or material bed roll mill 1 according to the invention—as indicated in FIGS. 1 to 3—is enclosed by a dustproof housing 26. Because of the previously described construction of the material bed roll mill 1 according to the invention with the rolls mounted at one end, only a relatively light construction of the protective housing 26 is necessary in this case, which moreover—as to some extent indicated by flange connections in FIG. 3—can be removed and installed relatively easily and quickly. In this way the rolls 2, 3 are sufficiently enclosed and protected by the dustproof housing 26.

What is claimed is:

1. A material bed roll mill omprising:

first and second rolls (2, 3) which are rotatably mounted in a machine frame (6), said first and second rolls being driven so that they rotate in opposite directions and pressed against one another with a pressing force of more than approximately 50 MPa and up to approximately 400 MPa;

a replaceable outer wear protection casing (2*b*, 3*b*) mounted on each end of the first and second rolls;

at least two (first and second) bearing jewels (8, 7) for each of the first and second rolls (2, 3), said bearing jewels (7, 8) being disposed in the machine frame (6) and are axially spaced from one another; and first and second roll shafts (4, 5) each projecting axially on one side and is rotatably mounted in the corresponding bearing jewels (7, 8) for rotating the first and second rolls;

wherein said first and second rolls (2, 3) are mounted at one end in the machine frame (6) each having only one roll shaft (4, 5); and wherein the first bearing jewel (8) adjacent to the first or second roll is retained as a bearing jewel which is displaceable transversely with respect to an axis of rotation (2*a*, 3*a*) of the roll, while the second bearing jewel (7) which is remote from the roll is disposed so as to be stationary; and wherein each of the first and second roll shafts (4, 5) is disposed so as to be pivotable in the region of the second bearing jewel (7) about a pivot axis (7*a*) extending transversely with respect to the axis of rotation (2*a*, 3*a*) of the roll.

2. The roll mill as claimed in claim 1, wherein the first bearing jewels (8) of the first and second rolls (2, 3) are disposed parallel adjacent to one another in the machine frame (6) in the normal operational state of the roll mill and are resiliently pressed against one another, wherein for setting of a parallel working gap (s) between the first and second rolls (2, 3), the first and second bearing jewels (8, 7) of the first and second roll shafts (4, 5) are adjustable in their reciprocal spacing, and wherein, in order to maintain the minimum gap spacing between the first and second rolls, an adjustable distance piece (16) is provided in the region between the two first bearing jewels (8) or fixed stop is provided on the first bearing jewel (8).

3. The roll mill as claimed in claim 2, wherein at least one pressing cylinder supplied with a pressure medium, particularly a hydraulic pressing cylinder or a hydropneumatic pressing cylinder (15), is coordinated with at least one of the two first bearing jewels (8).

4. The roll mill as claimed in claim 2, wherein each of the first and second rolls (2, 3) is equipped with a separate drive arrangement (11, 12) which is in drive connection with a free opposite end (4*a*, Sa) of each of the roll shafts (4, 5) connected to the roll.

5. The roll mill as claimed in claim 2, wherein, at its free end (4*b*, Sb) which projects with respect to the bearing jewels (7, 8), each roll shaft (4, 5) is constructed in the form of a basic roll body on which the wear protection casing (2*b*, 3*b*) constructed as a closed ring is replaceably fixed by means of a clamping connection (17), wherein said wear protection casing are removable towards this free end.

6. The roll mill as claimed in claim 5, wherein the free end (4*b*, Sb) of the roll shaft bearing the wear protection casing (2*b*, 3*b*) is constructed on its outer circumference as a seating surface (22) which tapers conically towards an end face (Sb') of this free end, and the wear protection casing (2*b*, 3*b*) has, on its inner circumference, a conical counter-seating surface (23) which is constructed corresponding to the outer circumference.

7. The roll mill as claimed in claim 6, wherein an oil pressing arrangement (24, 25) is co-ordinated with each roll (2, 3) for removing the wear protection casing (2*b*, 3*b*) from the free end (4*b*, Sb).

8. The roll mill as claimed in claim 1, wherein the first and second rolls (2, 3) are enclosed by a dustproof housing (26) which is removable from the machine frame (6).

* * * * *